US009789355B1

(12) United States Patent
Lo

(10) Patent No.: US 9,789,355 B1
(45) Date of Patent: Oct. 17, 2017

(54) PORTABLE ESCALATOR

(71) Applicant: DK City Corporation, Taichung (TW)

(72) Inventor: Chiu Hsiang Lo, Taichung (TW)

(73) Assignee: DK CITY CORPORATION, Taichung (TW)

( * ) Notice: Subject to any disclaimer, the term of this patent is extended or adjusted under 35 U.S.C. 154(b) by 0 days.

(21) Appl. No.: 15/248,681

(22) Filed: Aug. 26, 2016

(51) Int. Cl.
*A63B 22/04* (2006.01)
*A63B 24/00* (2006.01)

(52) U.S. Cl.
CPC ..... *A63B 22/04* (2013.01); *A63B 24/0087* (2013.01)

(58) Field of Classification Search
USPC ..... 482/54; 198/333
See application file for complete search history.

(56) References Cited

U.S. PATENT DOCUMENTS 4,927,136 A * 5/1990 Leask ..... A63B 22/04 198/323
5,120,050 A * 6/1992 Fowell ..... A63B 22/04 482/52
5,135,447 A * 8/1992 Robards, Jr. ..... A63B 21/157 482/52
5,145,475 A * 9/1992 Cares ..... A63B 21/157 482/52
5,295,928 A * 3/1994 Rennex ..... A63B 21/00178 482/51
5,328,420 A * 7/1994 Allen ..... A63B 22/04 482/37
5,381,881 A * 1/1995 Meyer ..... B66B 31/006 198/333
5,556,352 A * 9/1996 Chang ..... A63B 22/04 482/51
5,769,759 A * 6/1998 Alter ..... A63B 22/04 482/37
6,855,093 B2 * 2/2005 Anderson ..... A63B 22/205 482/51
7,204,361 B2 * 4/2007 Illedits ..... B66B 23/12 198/326
7,387,594 B1 * 6/2008 White ..... A63B 21/0083 482/112
9,216,317 B2 * 12/2015 Golen, Jr. ..... A63B 22/04
2007/0170038 A1 * 7/2007 Howard ..... B66B 23/12 198/333
2011/0177917 A1 * 7/2011 Patel ..... A63B 21/00181 482/52
2012/0264572 A1 * 10/2012 Fenster ..... A63B 22/04 482/52

* cited by examiner

*Primary Examiner* — Stephen R Crow

(57) ABSTRACT

A portable escalator includes a frame, a stair caterpillar, a driving device and a braking device. The driving device includes a motor, a chain-sprocket unit and a belt-pulley unit. The motor includes a mandrel and is connected to the frame. The chain-sprocket unit is connected to the stair caterpillar. The belt-pulley unit includes two pulleys and a belt. The first pulley is connected to the mandrel. The second pulley is connected to the chain-sprocket unit. The belt is provided on the first and second pulleys so that the motor is operable to drive the stair caterpillar through the belt-pulley unit and the chain-sprocket unit. The braking device is connected to the mandrel so that the braking device is operable to stop the mandrel.

6 Claims, 9 Drawing Sheets

PORTABLE ESCALATOR

BACKGROUND OF INVENTION

1. Field of Invention

The present invention relates to a portable escalator and, more particularly, to a compact escalator.

2. Related Prior Art Escalator

As disclosed in U.S. Pat. No. 9,216,317, a stair climber apparatus 10 includes an electric motor 22 connected to an output shaft 28. A drive belt 30 is provided on the output shaft 28 and a pulley 32. A shaft 34 is inserted in the pulley 32 and a lower sprocket 36. A chain 38 is provided on the lower sprocket 36 and an upper sprocket 40. Thus, the upper sprocket 40 is rotated as the electric motor 22 is actuated. A braking belt 50 is provided on the output shaft 28 and a braking pulley 52. A mechanical brake 48 is operable to prevent rotation of the pulley 52. Thus, the actuation of the mechanical brake 48 stops the rotation of the electric motor 22. However, the stair climber apparatus 10 is bulky for including many elements for driving and braking.

The present invention is therefore intended to obviate or at least alleviate the problems encountered in prior art.

SUMMARY OF INVENTION

It is the primary objective of the present invention to provide a compact portable escalator.

To achieve the foregoing objective, the portable escalator includes a frame, a stair caterpillar, a driving device and a braking device. The driving device includes a motor, a chain-sprocket unit and a belt-pulley unit. The motor includes a mandrel and is connected to the frame. The chain-sprocket unit is connected to the stair caterpillar. The belt-pulley unit includes two pulleys and a belt. The first pulley is connected to the mandrel. The second pulley is connected to the chain-sprocket unit. The belt is provided on the first and second pulleys so that the motor is operable to drive the stair caterpillar through the belt-pulley unit and the chain-sprocket unit. The braking device is connected to the mandrel so that the braking device is operable to stop the mandrel.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
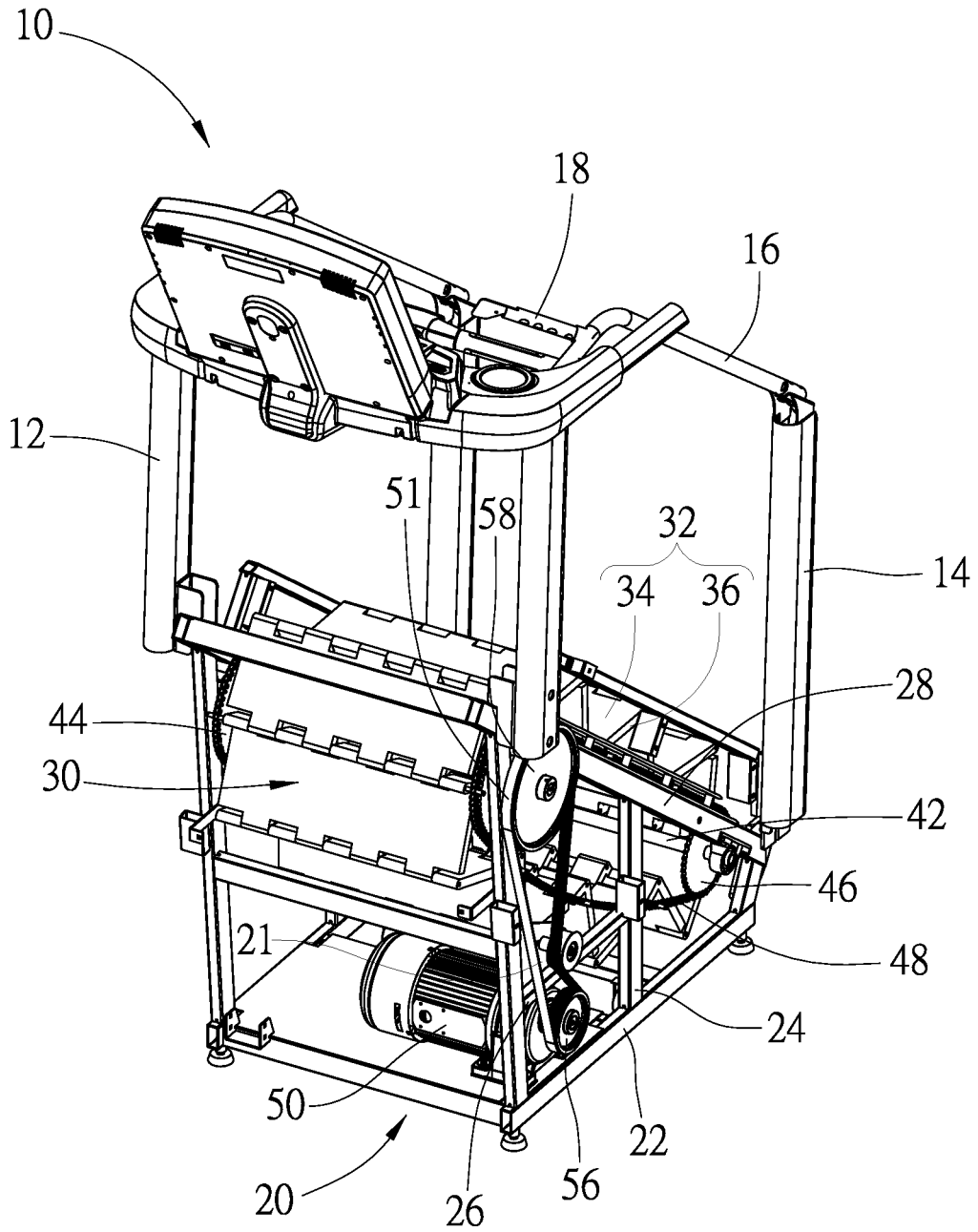
FIG. 1 is a perspective view of a portable escalator according to the preferred embodiment of the present invention.

Referring to FIGS. 1 through 5, a portable escalator 10 includes a frame 20, a stair caterpillar 30 and a driving device 40 according to the preferred embodiment of the present invention. The stair caterpillar 30 and the driving device 40 are supported on the frame 20. The stair caterpillar 30 is connected to the driving device 40 so that the stair caterpillar 30 can be driven by the driving device 40.

The frame 20 includes two bar or tube units on two sides. Each of the bar units includes two portions. The first portion includes a lower beam 22, a longer post 23, a shorter post 24, an upper beam 26 and an inclined bar 28. The longer post 23 is supported on a front portion of the lower beam 22 and the shorter post 24 is supported on a rear portion of the lower beam 22 so that they extend parallel to each other. The upper beam 26 includes a front end connected to the longer post 23 and a rear end connected to the shorter post 24, thereby enhancing each of the bar units. A plate 21 is connected to the longer post 23 and the upper beam 26. The plate 21 is used to support the driving device 40 in a manner to be described. The inclined bar 28 includes a front end connected to an upper end of the longer post 23 and a rear end connected to an upper end of the shorter post 24.

The upper portion includes a front post 12, a rear post 14 and an upper inclined bar 16. The front post 12 is connected to a portion of the inclined bar 28, near the upper end. The rear post 14 is connected to another portion of the shorter post 24, near the lower end. The upper inclined bar 16 includes a front end connected to an upper end of the front post 12 and a rear end connected to an upper end of the rear post 14.

There are two handles 18 each connected to the upper inclined bar 16 of a corresponding one of the bar units. When using the portable escalator, a user can hold the handles 18 or the upper inclined bars 16 to keep balance.

Electronic equipment is supported on the front posts 12 and the upper inclined bars 16. The equipment can include a programmable processor, a storage element (or "memory element"), a timer, an input/output element and other proper controlling elements. The electronic equipment is used to control the operation of the portable escalator.

The stair caterpillar 30 includes stairs 32 each including a tread 34 and a baffle 36. In each stair 32, the tread 34 is pivotally connected to the baffle 36. The tread 34 of each stair 32 is pivotally connected to the baffle 36 of an adjacent stair 32. Details of the stair caterpillar 30 can be found in U.S. Pat. No. 9,216,317 for example. The stair caterpillar 30 will not be further described in detail.

Figure 2:
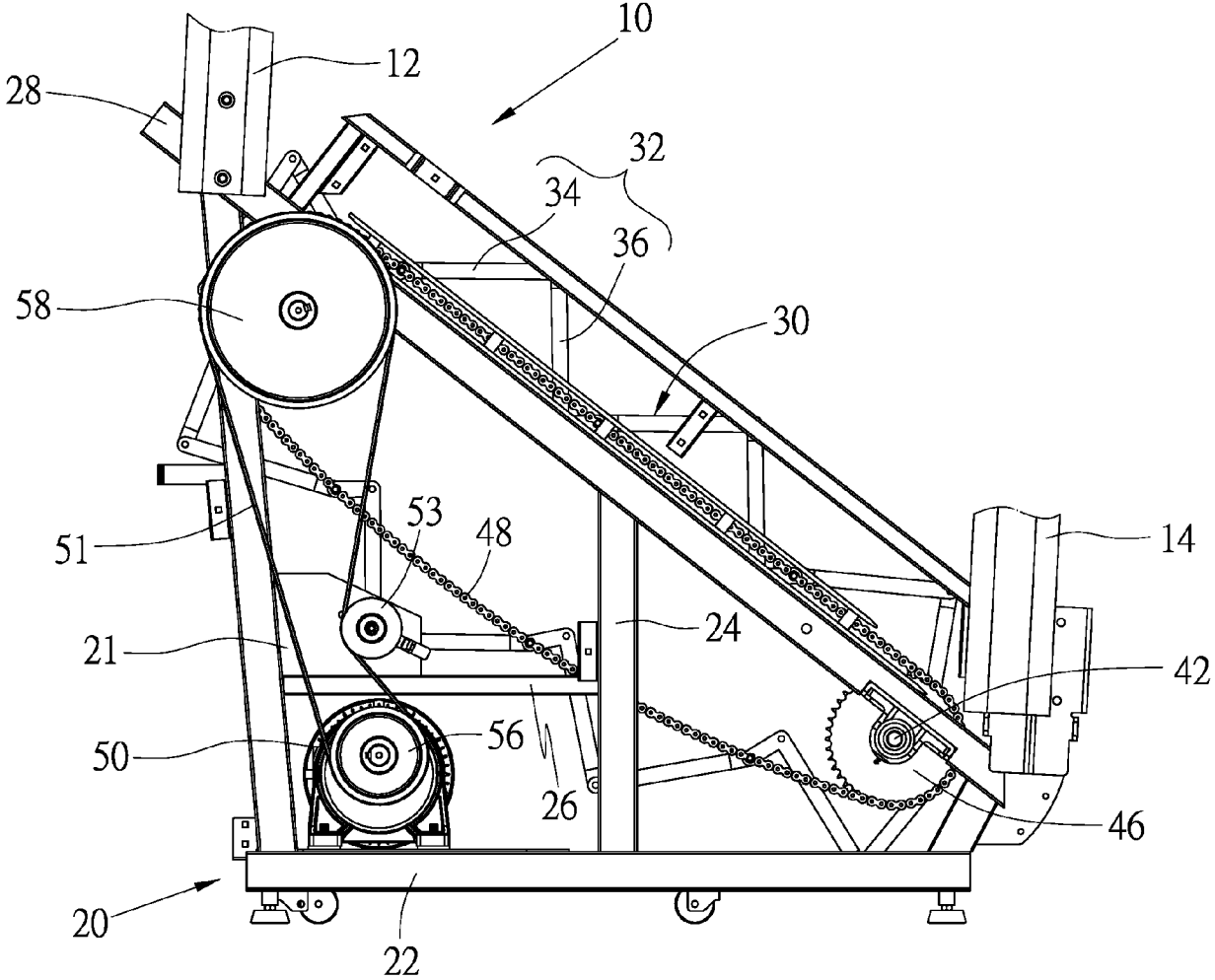
FIG. 2 is a side view of the portable escalator shown in FIG. 1.
Figure 3:
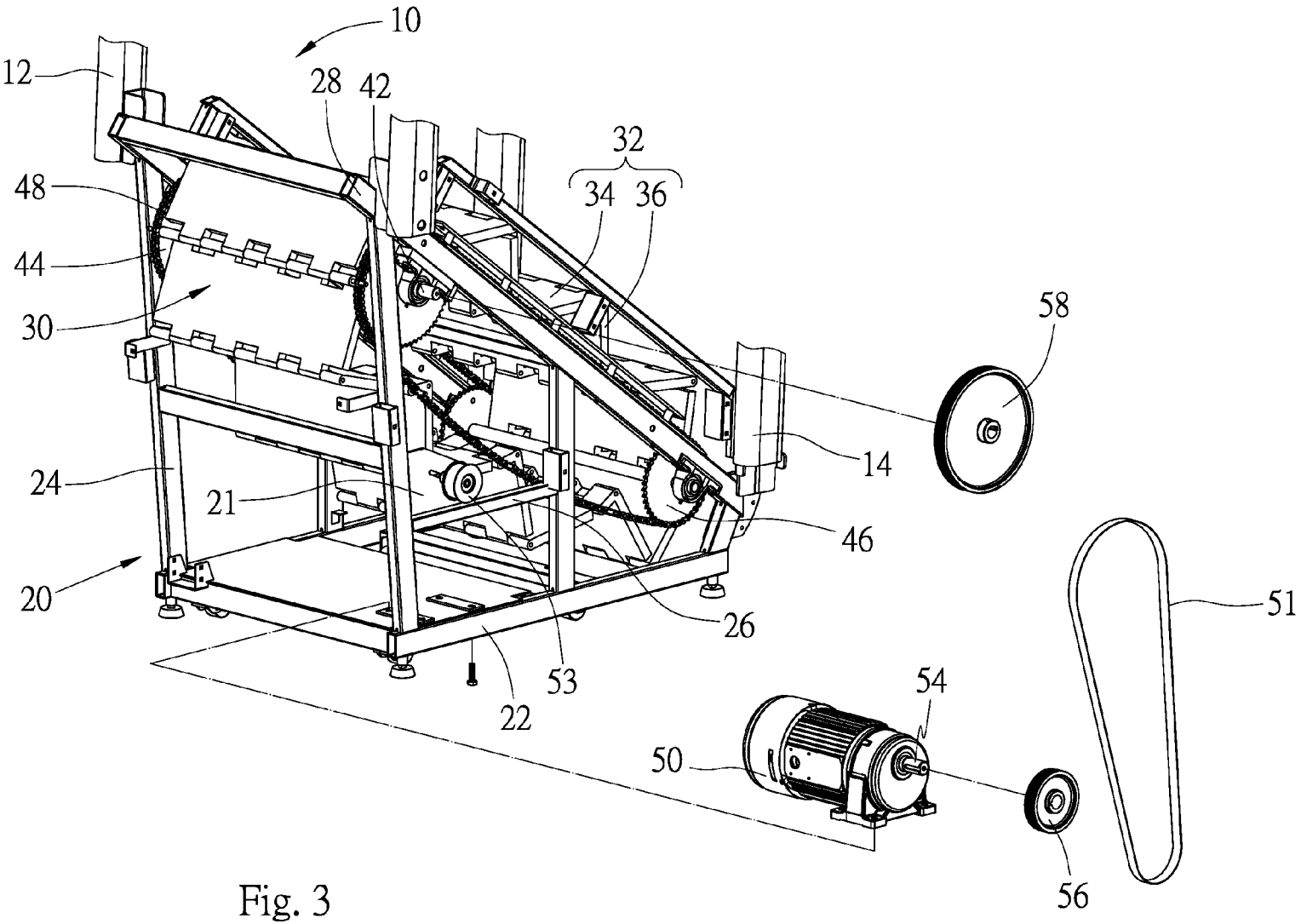
FIG. 3 is an exploded view of the portable escalator shown in FIG. 1.
Figure 4:
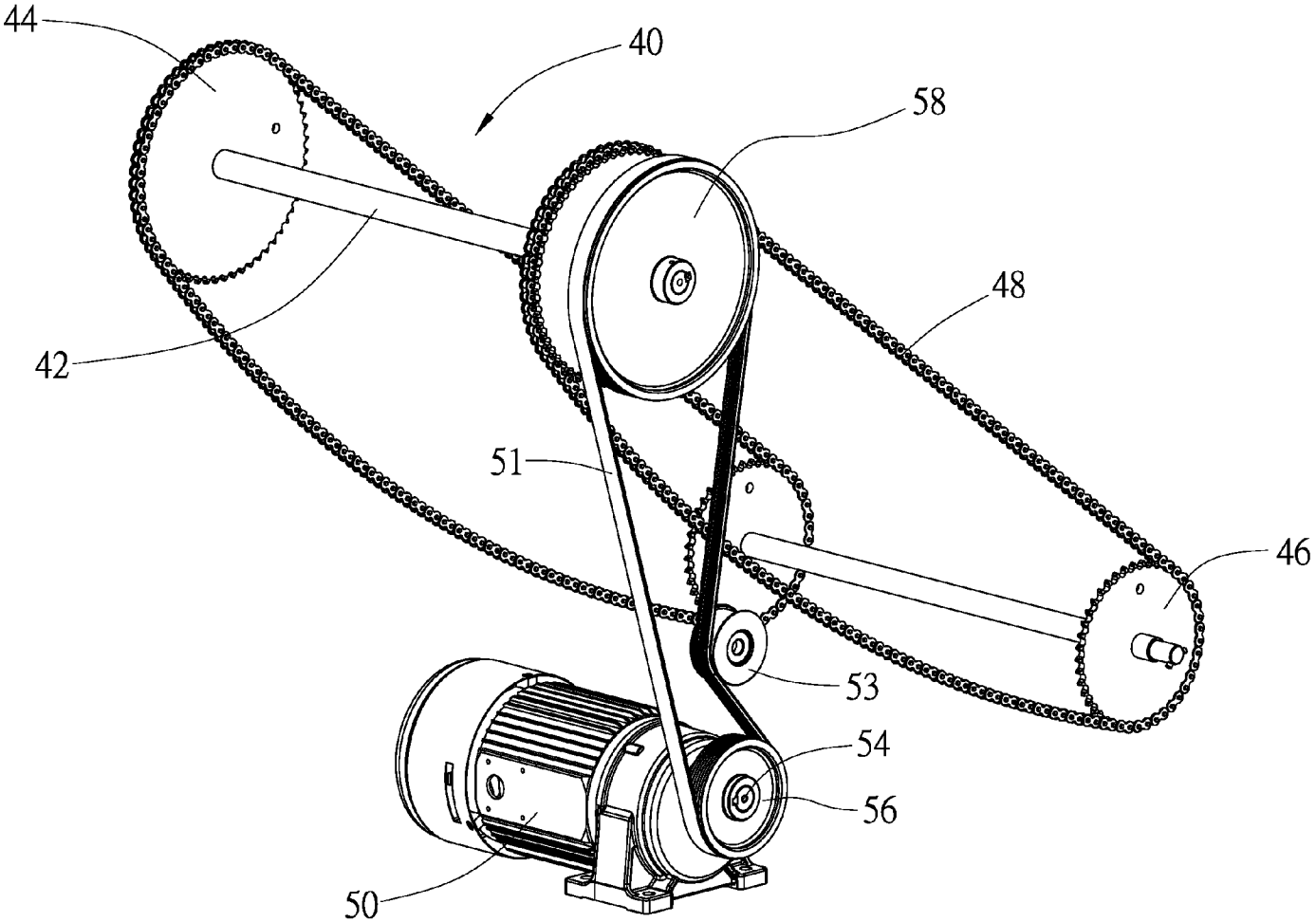
FIG. 4 is a perspective view of a driving device and a braking device of the portable escalator shown in FIG. 1.
Figure 5:
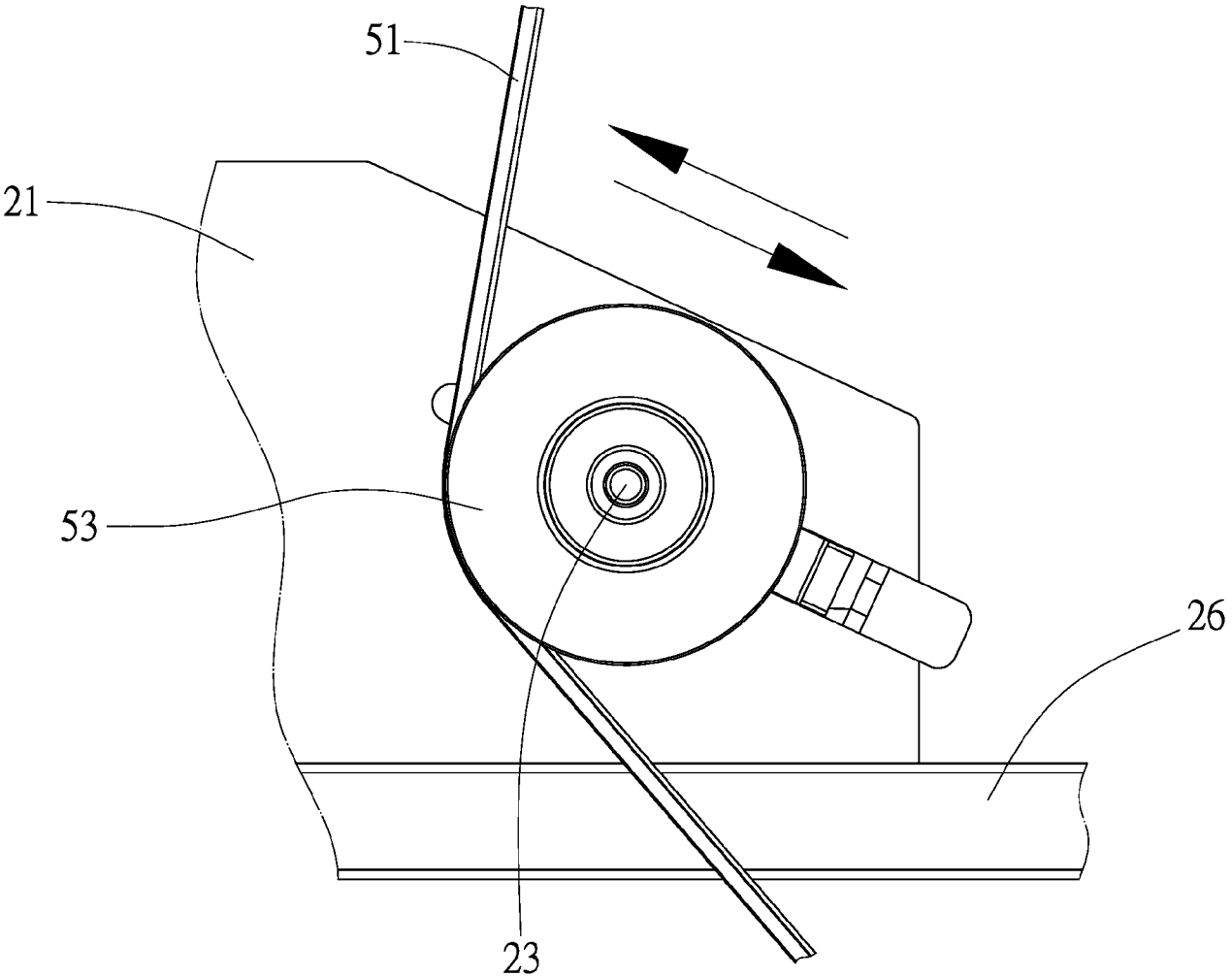
FIG. 5 is a partial, side view of the driving device shown in FIG. 4.

The driving device 40 includes two axles 42, a motor 50, a gearbox 70, a chain-sprocket unit and a belt-pulley unit. The axles 42 are attached to the frame 20 and, more particularly, to the inclined bars 28. For the convenience of the description, one of the axles 42 will be referred to as the "lower axle 42" and the other axle 42 will be referred to as the "upper axle 42." The lower axle 42 is located near lower (or "rear") ends of the inclined bars 28 (FIG. 2). The upper axle 42 is located near upper (or "front") ends of the inclined bars 28 (FIG. 3).

Figure 6:
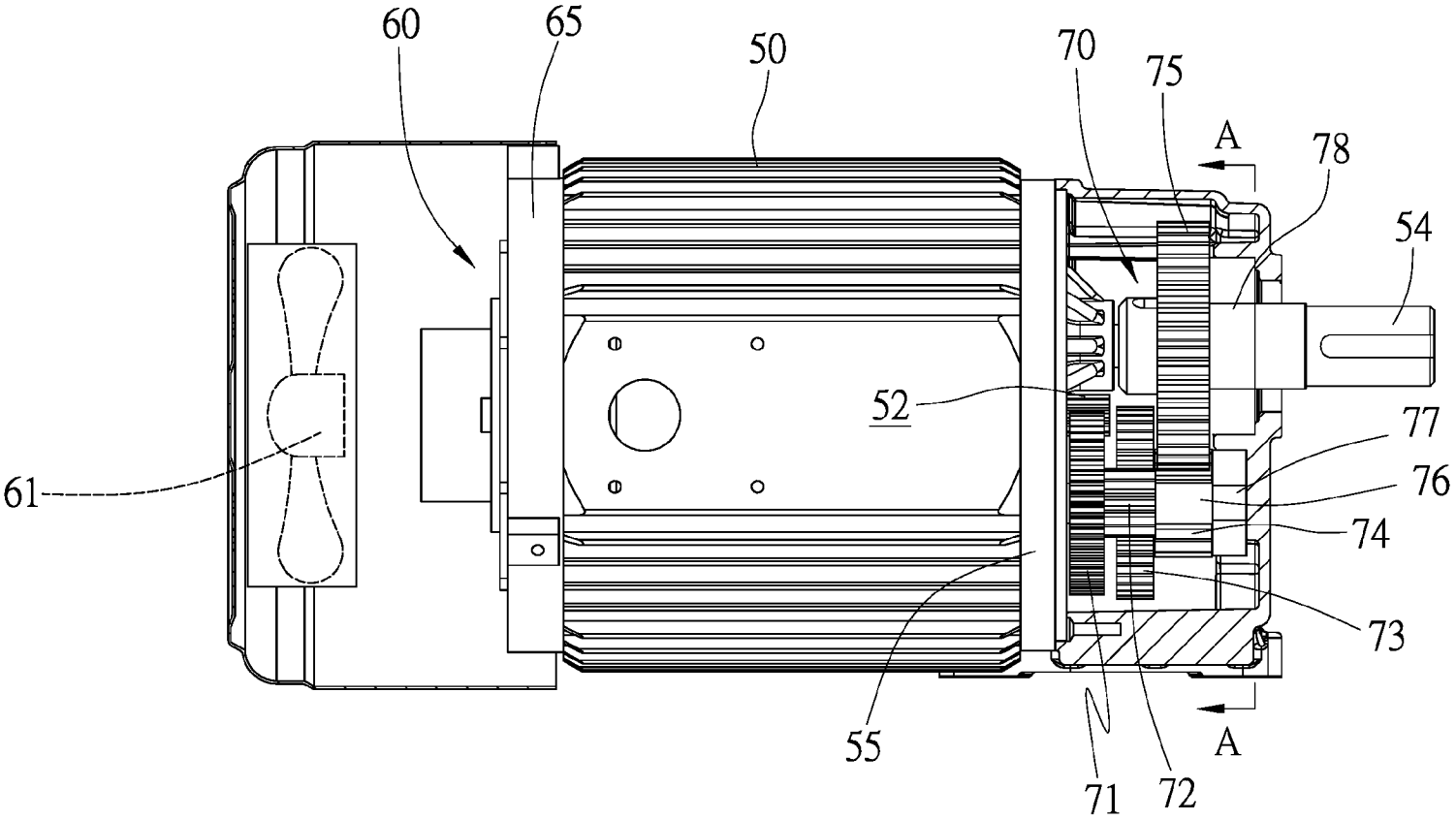
FIG. 6 is a front view of the driving device and the braking device shown in FIG. 4.
Figure 8:
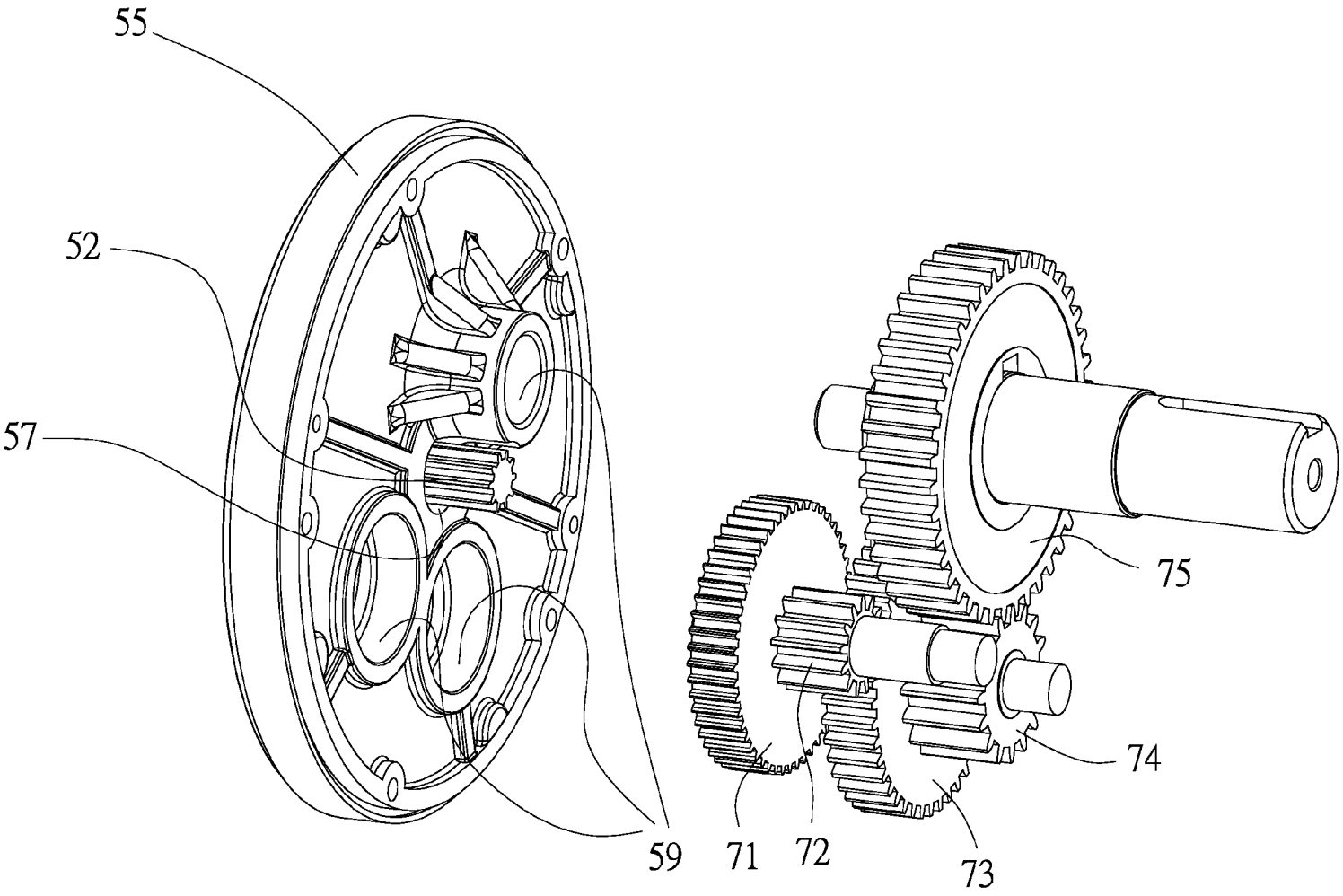
FIG. 8 is an explode view of a motor and a gearbox of the driving device shown in FIG. 6.
Figure 9:
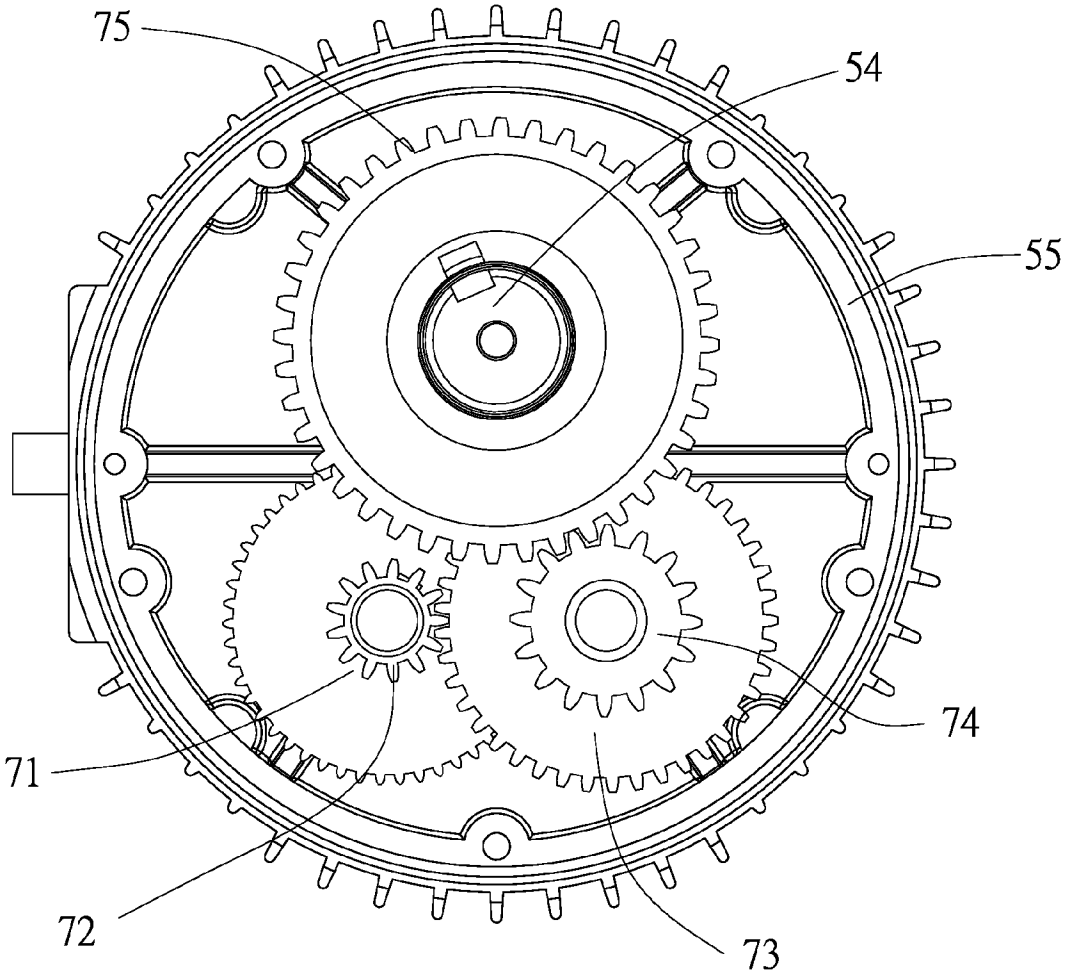
FIG. 9 is a side view of the gearbox shown in FIG. 8.

Referring to FIGS. 6, 8 and 9, the motor 50 includes a mandrel 52, a shell (not numbered) and two covers 55 and 65. The shell is supported on a platform (not numbered) that is supported on the lower beams 22 (FIGS. 1 and 2). The shell includes two open ends closed by the covers 55 and 65, respectively. The cover 55 includes an aperture 57 and three sockets 59. The aperture 57 is centrally made in the cover 55. The mandrel 52 is substantially inserted in the shell of the motor 50, with an end extending beyond the cover 55 via the aperture 57 and another end extending beyond the cover 65.

Referring to FIGS. 8 and 9, the gearbox 70 includes five gears 71, 72, 73, 74 and 75 and a power takeout axle 54. The gear 71 is engaged with a toothed portion of the mandrel 52 that is formed near the first end. The gear 72 is co-axially connected to the gear 71 by an axle 76. The gear 73 is engaged with the gear 72. The gear 74 is co-axially connected to the gear 73 by an axle 77. The gear 75 is engaged with the gear 74. The power takeout axle 54 is co-axially supported on the gear 75. The power takeout axle 54 is supported on a bearing 78.

An end of the axle 76 is inserted in one of the sockets 59. An end of the axle 77 is inserted in another one of the sockets 59. An end of the power takeout axle 54 is inserted in the other socket 59.

The chain-sprocket unit includes two upper sprockets 44, two lower sprockets 46 and two chains 48. The upper sprockets 44 are connected to the upper axle 42. The lower sprockets 46 are connected to the lower axle 42. Each of the chains 48 is provided on a corresponding one of the upper sprockets 44 and a corresponding one of the lower sprockets 46. The chains 48 are connected to the stairs 32 in a conventional manner.

The belt-pulley unit includes a belt 51, an idle pulley 53, a lower pulley 56 and an upper pulley 58. The lower pulley 56 is co-axially connected to another end of the power takeout axle 54. The upper pulley 58 is supported on the upper axle 42.

The idle pulley 53 is supported on the plate 21 in a movable and elastic manner. The idle pulley 53 is located against the belt 51 to keep the tension in the belt 51 at an adjustable value.

The motor 50 can be actuated to drive the belt-pulley unit via the gearbox 70. The belt-pulley unit drives the chain-sprocket unit via the upper axle 42. The chain-sprocket unit drives the stair caterpillar 30.

Figure 7:
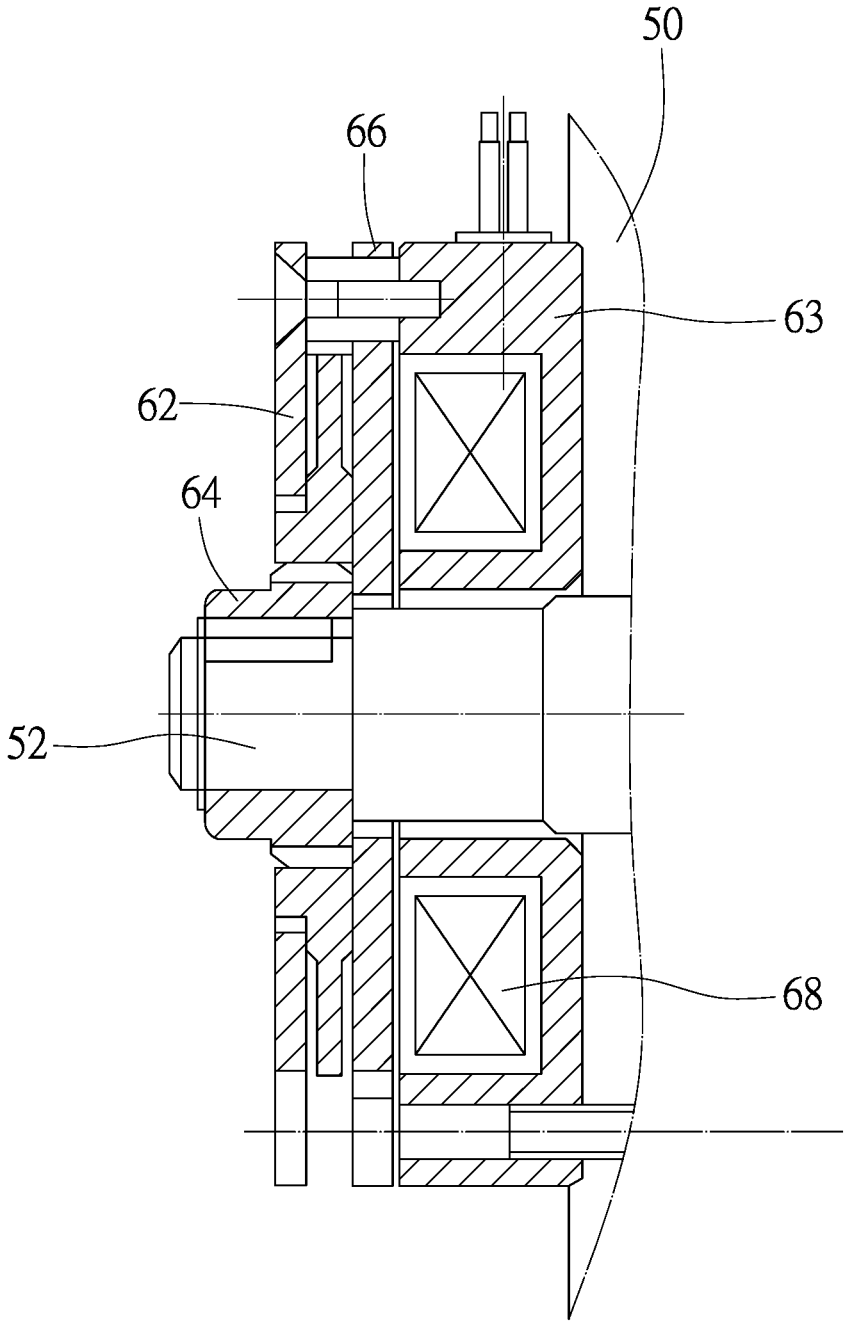
FIG. 7 is a cross-sectional view of the braking device of FIG. 6.

Referring to FIGS. 6 and 7, the portable escalator 10 further includes a braking device 60. The braking device 60 includes a cover 62, a mount 63, a lining 64, a brake disc 66 and a solenoid 68. The mount 63 is attached to the shell of the motor 50. The cover 62 is attached to the mount 63. The solenoid 68 is supported on or in the mount 63. The brake disc 66 is provided between the cover 62 and the mount 63 in a translational manner. That is, the brake disc 66 is not rotatable. The lining 64 is connected to a portion of the mandrel 52 near the second end.

The solenoid 68 can be actuated to attract the brake disc 66 so that the brake disc 66 is kept away from the lining 64. Thus, the lining 64 is allowed to rotate freely, and so is the mandrel 52. Hence, the stair caterpillar 30 is driven.

The solenoid 68 can be turned off to release the brake disc 66. The brake disc 66 can be brought into contact with the lining 64 by a spring for example. Thus, the lining 64 is stopped, and so is the mandrel 52. Hence, the stair caterpillar 30 is stopped.

A fan 61 is attached to the second end of the mandrel 52. The fan 61 is operable to propel air to cool the lining 64 and the brake disc 66 and the motor 50.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A portable escalator comprising:
- a frame;
- a stair caterpillar;
- a driving device comprising:
  - a motor comprising a mandrel formed with two ends, wherein the motor is connected to the frame;
  - a gearbox comprising a first gear connected to one of the ends of the mandrel, a second gear coaxially connected to the first gear, a third gear engaged with the second gear, a fourth gear coaxially connected to the third gear, a fifth gear engaged with the fourth gear and a power takeout axle co-axially connected to the fifth gear at an end;
  - a chain-sprocket unit connected to the stair caterpillar;
  - a belt-pulley unit comprising:
    - a first pulley co-axially connected to the power takeout axle;
    - a second pulley connected to the chain-sprocket unit; and
    - a belt provided on the first and second pulleys so that the motor is operable to drive the stair caterpillar via the belt-pulley unit and the chain-sprocket unit; and
- a braking device connected to the second end of the mandrel so that the braking device is operable to stop the mandrel.

2. The portable escalator according to claim 1, wherein the frame comprises two beams, two posts each connected to a corresponding one of the beams, and two inclined bars each connected to a corresponding one of the posts.

3. The portable escalator according to claim 1, wherein the frame comprises a plate attached to one of the posts, wherein the belt-pulley unit comprises an idle pulley attached to the plate and abutted against the belt.

4. The portable escalator according to claim 3, wherein the chain-sprocket unit comprises an upper axle connected to the inclined bars, a lower axle connected to the other inclined bars, two upper sprockets connected to the upper axle, two lower sprockets connected to the lower axle, and a chain provided on the upper and lower sprockets.

5. The portable escalator according to claim 1, wherein the second pulley is connected to the upper axle.

6. The portable escalator according to claim 1, wherein the motor comprises a fan connected to the mandrel, near the braking device.

* * * * *